United States Patent [19]

Steele

[11] 3,952,956

[45] Apr. 27, 1976

[54] BIN AERATOR

[75] Inventor: James R. Steele, Stillwater, Minn.

[73] Assignee: Dynamic Air Inc., St. Paul, Minn.

[22] Filed: Mar. 31, 1975

[21] Appl. No.: 563,717

[52] U.S. Cl. ..... 239/289; 239/534; 239/602; 134/167 R

[51] Int. Cl.[2] ..... B05B 15/00; B05B 1/30; B08B 3/02

[58] Field of Search ..... 239/534, 289, 602; 15/405, 406, 415, 419; 134/166 R, 167 R; 181/64 B, 65, 40

[56] References Cited

UNITED STATES PATENTS

| | | | |
|---|---|---|---|
| 1,960,235 | 5/1934 | Eisinger | 134/167 R X |
| 2,563,337 | 8/1951 | Jaeger | 239/534 X |
| 2,890,838 | 6/1959 | Jannsen | 239/534 |
| 2,933,102 | 4/1960 | Hillman et al. | 239/534 UX |
| 3,269,664 | 8/1966 | Lamb et al. | 239/602 X |
| 3,408,006 | 10/1968 | Stanwood | 134/167 R X |
| 3,423,025 | 1/1969 | Rodger | 239/534 X |
| 3,590,945 | 7/1971 | Murphy | 181/65 X |
| 3,754,740 | 8/1973 | Piper | 239/534 X |

*Primary Examiner*—Robert S. Ward, Jr.
*Attorney, Agent, or Firm*—Jacobson and Johnson

[57] ABSTRACT

A bin aerator for dislodging materials from the walls of a bin with the aerator comprising a deformable vibrating rubber housing having a circular discharge region for discharging air parallel to the walls of the bin.

4 Claims, 2 Drawing Figures

BIN AERATOR

BACKGROUND OF THE INVENTION

1. Field of the Invention

This invention relates generally to bin aerators and more specifically to pneumatic operated bin aerators for dislodging stuck materials from the walls of a storage bin.

2. Description of the Prior Art

The concept of pneumatic aerators for dislodging stuck granular materials in bins is old in the art. An example of such devices is shown in the Kelley U.S. Pat. No. 3,393,943 in which a spherical shaped chamber contains air ports therein for discharging spurts of air through the ports to thereby dislodge material located around the air chamber. Another embodiment of this prior art device comprises a spherical shaped chamber in which a rubber cap is placed over the outside of the air ports to prevent back flow of granular material into the aerator when the aerator is not in use. One of the shortcomings of these prior art devices is that if the granular material is abrasive the aerator produces extensive wear on the bin wall which often results in weakening or actual wearing a hole in the bin wall. In addition, the prior art aerators using the rubber cap would sometimes blow off in use consequently clogging the aerator. Furthermore, the air pattern with these prior art units also produces areas or regions of congealed material around the aerator. The present invention comprises an improvement over these prior art devices in which the main body has air ports located so as to discharge air substantially parallel to the bin walls and at the same time cause vibrating motion of the pliable aerator body thereby insuring material which is on the bin aerator and adjacent to the bin aerator to dislodge even though it is not directly impinged on by the air stream.

BRIEF SUMMARY OF THE INVENTION

Briefly, the present invention comprises a bin aerator in which air is introduced into a chamber that is covered with a flexible material which prevents air from discharging into the bin until the pressure reaches a predetermined level. After the air pressure reaches a predetermined level, the pliable rubber covering flexes allowing air to escape and at the same time causes the surface of the aerator to vibrate and thereby dislodge any material on the surface of the bin aerator as well as any material in the path of the discharging air.

DESCRIPTION OF THE PREFERRED EMBODIMENT

Figure 1:
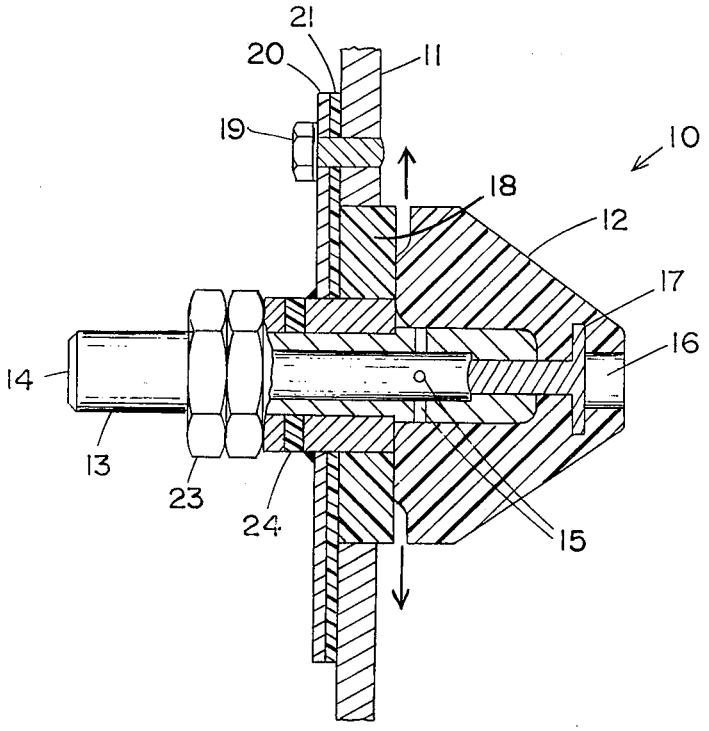
FIG. 1 is a side view of the bin aerator of my invention.

Referring to FIG. 1, reference numeral 10 generally shows in section the bin aerator of my invention. Bin aerator 10 comprises a flexible frusto-conical member 12 which is fastened to one end of conduit 13 by a set screw 16 and a washer 17. Located in conduit 13 are a set of openings 15 which form an air path from a central opening 14 located in conduit 13 to the inside surface between member 12 and member 18. Typically, conduit 13 is fastened to the wall of a bin 11 by suitable fasteners 23. A gasket 24 and washer can also be provided to form an air tight seal of the aerator to the bin wall. In addition, flange 20 of the aerator is fastened in an air tight seal to bin wall 11 through a rubber gasket 21 which is held in pressure contact between wall 11 and flange 20 by a stud bolt 19. While only one stud bolt is shown, it is preferred to use a number of bolts to evenly hold the flange against the wall of the bin. A rubber insert 18 is located in the opening in bin wall 11 to act as both a seal and a path for directing air along the bin wall 11.

Figure 2:
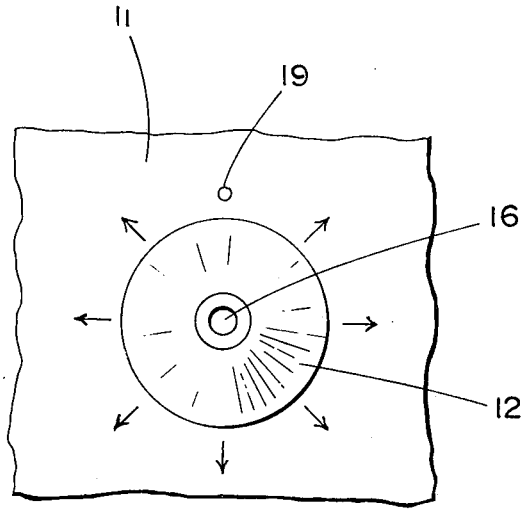
FIG. 2 is an end view of the bin aerator of my invention.

As can be seen in FIG. 2, member 12 has a circular shape and is preferably made out of a flexible material such as rubber having a durometer hardness of 70 to 90 as measured on the Shore A Scale.

In operation of my bin aerator, pressurized air enters conduit 14. The pressure at the openings 15 increase until body member 12 surrounding openings 15 flexes and allows the air to escape. As the air pressure 15 causes member 12 to flex, it allows the air to discharge with considerable momentum. Member 12 has a flat surface which is in contact with a similar flat surface on member 18. These two flat surfaces coact to provide an air discharge passage to allow air to escape in a 360° pattern. It has been found with this type of design, i.e., with the air opening directly parallel to the bin, avoids wear on the bin walls and produces a better mixing and flow pattern. Furthermore, the streamlined design results in less material gathering around the bin aerator. A further advantage is that the member 12 must flex to discharge air. As the air continues to pass between the surfaces of member 12 and member 18, it causes member 12 to vibrate and thereby dislodge material over to adjacent member 12. A further feature of this invention over the prior art is that greater air pressure can be applied to this unit than the prior art units without fear of harming the aerator. A typical problem with prior art units was that the rubber cap would blow off if a rubber cap was used. Since the present body member is held securely in place, even a very large force would not dislodge the body member of the present invention.

A further advantage is that vibration of bin aerator body 12 when the air is supplied to the chambers and exhaust ports 15 continues as long as the aerator takes the path of least resistance which will vary as conditions vary around the aerator.

I claim:

1. A bin aerator for dislodging material stuck to a bin wall comprising:

a first member for projecting through an opening in a bin wall and having means for fastening said bin aerator to said bin wall; and a fastening member for attachment to said first member;

a pliable body member for mounting inside a bin, said pliable body member having a surface for the discharge of air, a second member having a surface for the discharge of air and said pliable body member and said second member having a central opening therein for receiving said first member and said fastening member; said surface on said pliable body member and said surface on said second member located in pressure contact by the coaction of said fastening member and said first member;

means for suppying air to the surface on said pliable body member and the surface on said second member to thereby cause said pliable member to flex and bend as air is discharged over said surface on said pliable body member to thereby dislodge any material lodged on said bin wall.

2. The invention of claim 1 wherein said surface on said pliable body member and said surface on said second member are located so that when said bin aerator is mounted on a bin wall at least a portion of said surface of said pliable body member is parallel to said bin wall.

3. The invention of claim 1 wherein said pliable body member is frusto-conical in shape.

4. The invention of claim 1 wherein said pliable body member comprises an elastomer having a hardness in the range of 70 to 90 as measured on the Shore A Scale.

* * * * *